US010928162B2

(12) United States Patent
Trimble

(10) Patent No.: US 10,928,162 B2
(45) Date of Patent: Feb. 23, 2021

(54) FIREARM COMBINATION TARGETING SYSTEM

(71) Applicant: James Trimble, Eureka, CA (US)

(72) Inventor: James Trimble, Eureka, CA (US)

( * ) Notice: Subject to any disclaimer, the term of this patent is extended or adjusted under 35 U.S.C. 154(b) by 0 days.

(21) Appl. No.: 16/829,920

(22) Filed: Mar. 25, 2020

(65) Prior Publication Data

US 2020/0378723 A1 Dec. 3, 2020

Related U.S. Application Data

(60) Provisional application No. 62/823,084, filed on Mar. 25, 2019.

(51) Int. Cl.

| | |
|---|---|
| ***F41C 27/00*** | (2006.01) |
| ***F41G 3/16*** | (2006.01) |
| ***F41A 19/68*** | (2006.01) |
| ***F41G 3/04*** | (2006.01) |

(52) U.S. Cl.

CPC ..... *F41G 3/165* (2013.01); *F41A 19/68* (2013.01); *F41G 3/04* (2013.01)

(58) Field of Classification Search

CPC ..... F41C 27/00; F41A 19/00; F41A 19/08; F41A 19/18; F41A 19/59; F41A 11/02; F41G 3/225; F41G 5/06; F41G 5/00; F41G 11/00

See application file for complete search history.

(56) References Cited

U.S. PATENT DOCUMENTS

| | | | | |
|---|---|---|---|---|
| 6,965,312 | B2 | 11/2005 | Lerg | |
| 8,281,512 | B2 * | 10/2012 | Lara | F41C 27/00 42/85 |
| 8,739,452 | B1 | 6/2014 | Calvert | |
| 8,763,295 | B2 * | 7/2014 | Trimble | F41C 23/12 42/72 |
| 2015/0241153 | A1 | 8/2015 | Mardirossian | |
| 2017/0010073 | A1 * | 1/2017 | Downing | F41G 3/165 |
| 2017/0328677 | A1 * | 11/2017 | Gull | F41G 3/165 |
| 2019/0003803 | A1 * | 1/2019 | Kapogianis | F41G 3/12 |
| 2020/0003523 | A1 * | 1/2020 | Lacagnina | G02B 27/017 |

* cited by examiner

*Primary Examiner* — J. Woodrow Eldred

(57) ABSTRACT

A targeting system comprising a helmet, primary firearm, and secondary firearm. The helmet includes a helmet display. a primary firearm comprising: a receiver, a primary barrel, a primary camera, a swivel control, a first mounting point, a first display, and a second display. The secondary firearm includes a camera and a secondary barrel. The computing device comprises an user interface. The control circuit is coupled to the helmet, the firearm apparatus, and the user interface. The primary barrel is functionally coupled to the receiver. The helmet display is a heads-up display. The swivel control is functionally coupled to the secondary firearm. The secondary firearm is rotatably coupled to the first mounting point. The control circuit is configured to capture and convey images and video; receive a targeting instruction on the secondary firearm from the user interface; and instruct the swivel control to acquire a sight picture.

20 Claims, 12 Drawing Sheets

FIREARM COMBINATION TARGETING SYSTEM

FIELD OF THE INVENTION

The instant disclosure relates generally to targeting systems. More specifically, the instant disclosure describes firearm combination targeting systems.

BACKGROUND OF THE INVENTION

In the past, there has not been a way for a single soldier to fire at two different targets located in different directions at one time, short of using two separate weapons. While in a hostile environment, the soldier would benefit from a firearm with which he/she can shoot around a corner without exposing him/herself and at the same time able to cover his/her front with another weapon. While there are firearms with a variety of attachments, these attachments are generally fixed and do not allow a user to aim each weapon in a separate direction. In addition, commonly only a single part of the firearm may be utilized at any one time. Though there are weapons that are capable of firing around an obstacle they often have a limited angle of coverage. At most, such weapons can cover a 90 degrees spread from the default firing alignment. In addition, even while many existing solutions provide some sort of display, the integration and capabilities of the display are not perfectly suited for a weapon with a large angle of motion.

BRIEF DESCRIPTION OF THE DRAWINGS

Some of the embodiments will be described in detail, with reference to the following figures, wherein like designations denote like members, wherein.

Figure 1:
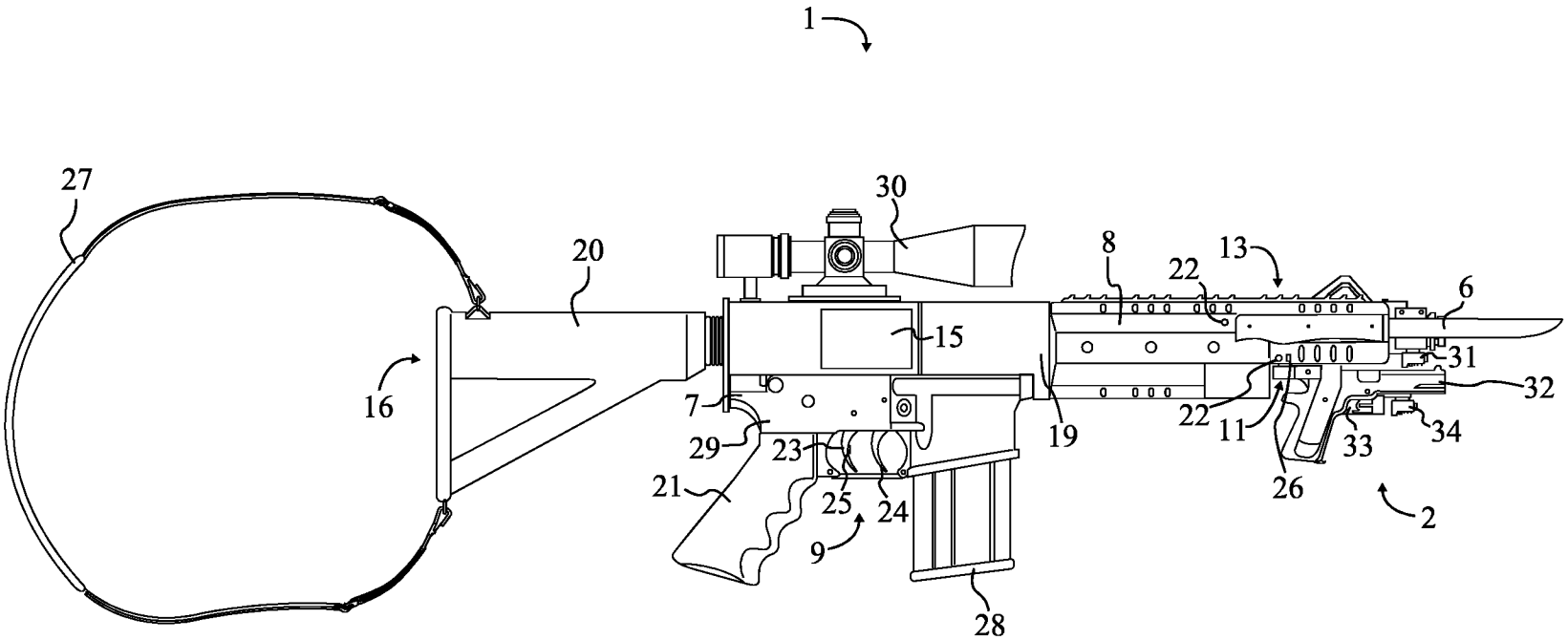
FIG. 1 illustrates a left side view of a primary firearm and a secondary firearm demountably coupled together ("firearm combination") according to some embodiments.

Unless otherwise specifically noted, articles depicted in the drawings are not necessarily drawn to scale.

DETAIL DESCRIPTIONS OF THE INVENTION

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods.

Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "dorsal" refers to positions that are located near, on, or towards the upper or top side of a structure.

The present disclosure includes many aspects and features. Moreover, while many aspects and features relate to, and are described in the context of detection of presence of one or more intruder devices., embodiments of the present disclosure are not limited to use only in this context.

In the past there has not been a way for a single soldier to fire at two different targets located in different directions at one time, short of using two separate weapons. While in a hostile environment, the soldier would benefit from a firearm with which he/she can shoot around a corner without exposing him/herself and at the same time able to cover his/her front with another weapon. While there are firearms with a variety of attachments, these attachments are generally fixed and do not allow a user to aim each weapon in a separate direction. In addition, commonly only a single part of the firearm may be utilized at any one time. Though there are weapons that are capable of firing around an obstacle they often have a limited angle of coverage. At most, such weapons can cover a 90-degree spread from the default firing alignment. In addition, even while many existing solutions provide some sort of display, the integration and capabilities of the display are not perfectly suited for a weapon with a large angle of motion.

The instant disclosure seeks to provide a firearm combination apparatus of a firearm that has a pivoting pistol below a long barreled gun with a liquid crystal display (LCD) screen so the soldier can fire around a corner or edge wall without exposing his/her body and at the same time be aiming at a different target with the same weapon. The instant disclosure further seeks to provide a firearm combination apparatus that is in communicatively coupled to and controllable by external devices, thereby improving overall awareness of a user of the present invention.

The present invention is a battery operated and computerized firearm combination that incorporates two weapons into a single apparatus. In the preferred embodiment, the two weapons are individual firearms, referred to as the primary firearm 1 and secondary firearm 2. Shown in FIG. 1-FIG. 6, the firearm combination comprises a primary firearm 1, a secondary firearm 2, a communications module 3, a battery 4, an electroshock weapon 5, and a knife 6. The secondary firearm 2 is removably attached to the primary firearm 1 and is capable of rotating to face a different angle than the primary firearm 1. The secondary firearm 2 can rotate 150 degrees in either direction from parallel with the primary firearm 1, for a total of 300 degrees of rotation.

This allows the secondary firearm 2 to point in a partially rearwards direction. In combination with the primary firearm 1, the secondary firearm 2 allows a user to fire at two targets simultaneously. The communications module 3 allows the present invention to transmit relevant data to other devices, while the battery 4 provides power for the communications module 3 and other internal components. The electroshock weapon 5 and the knife 6 connect to the front of the primary invention and can be detached to be used independently. It is also possible for the computerized aspect of the present invention to be omitted, resulting in a simpler and less expensive primary firearm 1 with an attached rotatable secondary firearm 2.

Figure 2:
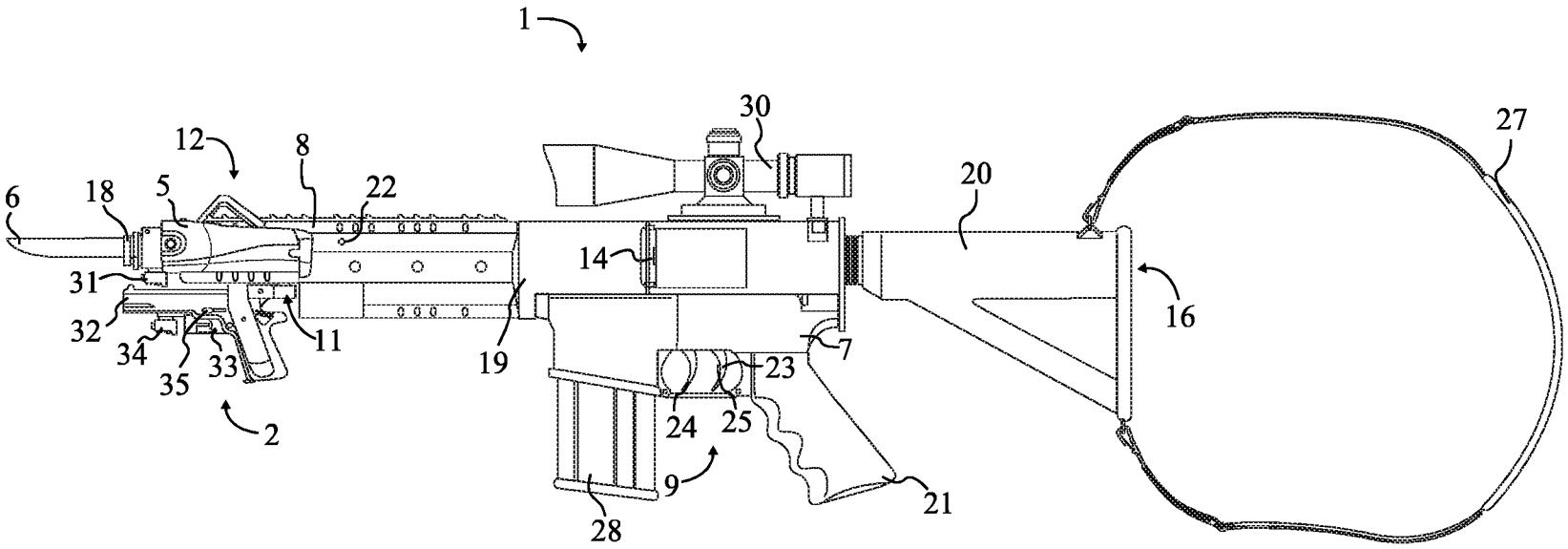
FIG. 2 illustrates a right side view of the firearm combination according to certain embodiments.

The primary firearm 1 comprises a receiver 7, a high powered primary barrel 8, a trigger 9, a swivel control 10, a first mounting point 11, a second mounting point 12, a third mounting point 13, a first display 14, a second display 15, a stock 16, and a set of accessories 17. These components are illustrated in FIG. 1 and FIG. 2. The primary barrel 8 comprises a muzzle 18, located at the front end of the barrel. The primary barrel 8 can include one or more barrels (e.g., double barrel, Gatlin gun, and similar multi-barrel firearm). The stock 16 comprises a forend 19, a telescoping shoulder rest 20, and a rear grip 21. The stock 16 allows a user to hold the primary firearm 1, with the barrel being connected to the forend 19. Connected to the barrel, forming a middle part of the stock 16, is the rear grip 21. Behind the rear grip 21 is the telescoping shoulder rest 20. The forend 19 and the rear grip 21 allow a user to hold the primary firearm 1, with one hand grasping the rear grip 21 and another hand supporting the forend 19. The telescoping shoulder allows a user to brace the primary firearm 1 against their torso. The first mounting point 11, second mounting point 12, and third mounting point 13 each include a quick-release mechanism 22. This quick-release mechanism allows a user to easily and quickly remove an attached device, such as the secondary firearm 2, electroshock weapon 5, or knife 6, from the present invention.

The trigger 9 is connected to both the stock 16 and the receiver 7, next to the rear grip 21. The trigger 9 enables a user to easily fire the primary firearm 1 with the same hand that holds the rear grip 21, as seen in FIG. 1 and FIG. 2. The trigger 9 comprises a first trigger 23, a second trigger 24, and an electronic trigger 25, with the first trigger 23 being located behind the second trigger 24. The first trigger 23 (the rear trigger) is used to fire the primary firearm 1 while the second trigger 24 (the front trigger) is used to fire the secondary firearm 2. The first trigger 23 and second trigger 24 are aligned with each other, allowing a user to quickly switch between firing the primary firearm 1 and the secondary firearm 2. The setup of the first and second trigger 24 also allow a user to fire the primary firearm 1 and secondary firearm 2 simultaneously. The electronic trigger 25 is attached to the first trigger 23, being clamped in place.

Figure 3:
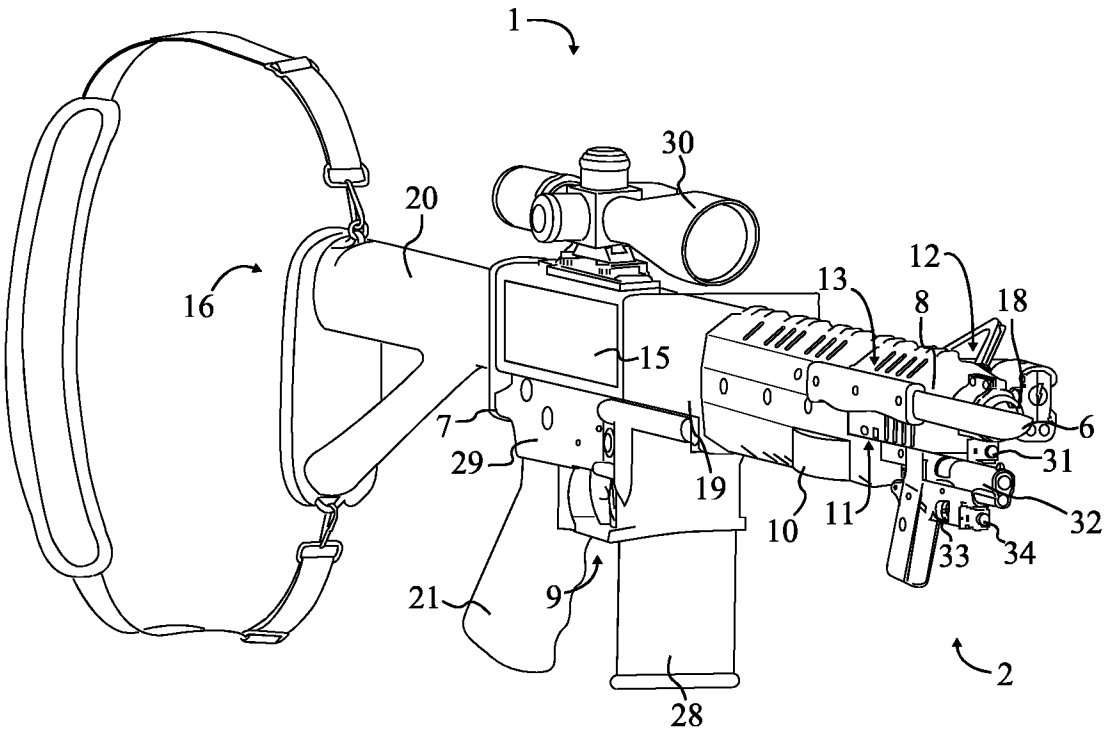
FIG. 3 illustrates a front perspective view of the firearm combination according to other embodiments.
Figure 4:
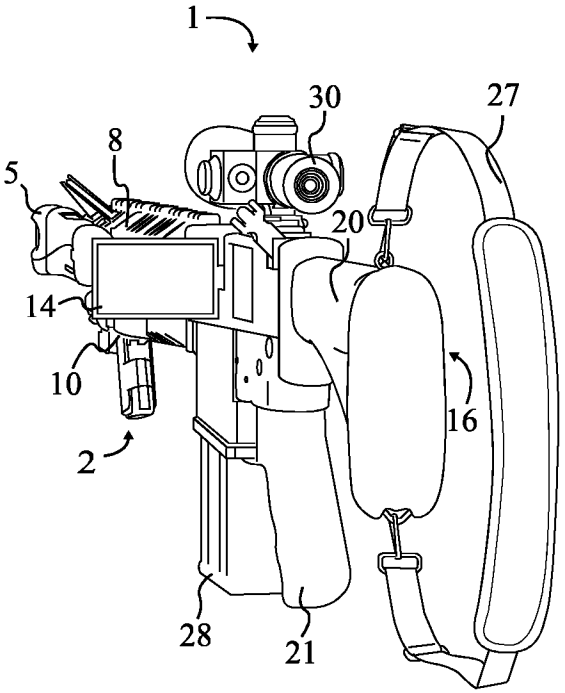
FIG. 4 illustrates a rear perspective view of the firearm combination according to yet still other embodiments.
Figure 5:
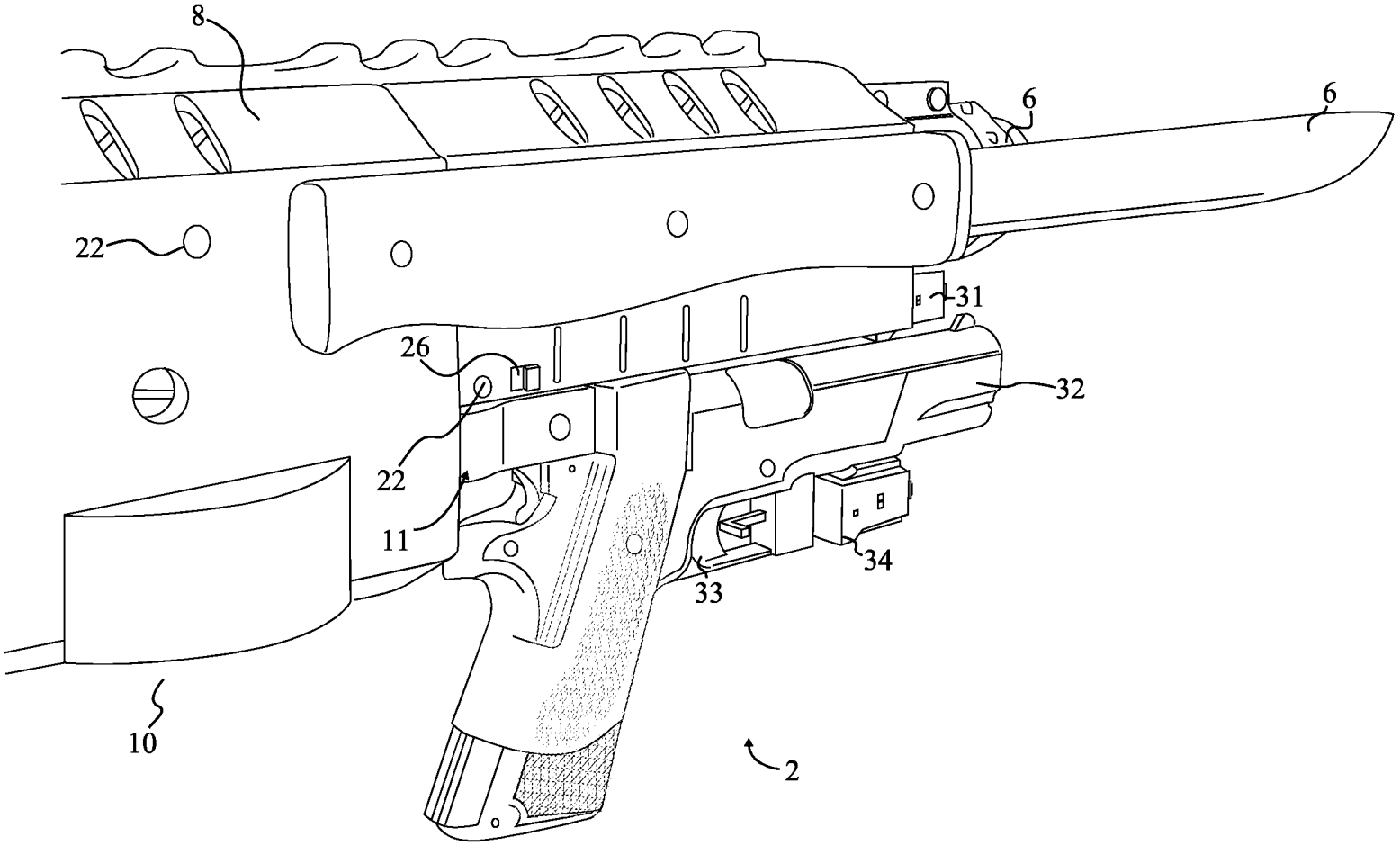
FIG. 5 illustrates a close-up the forend of the firearm combination according to some embodiments.
Figure 6:
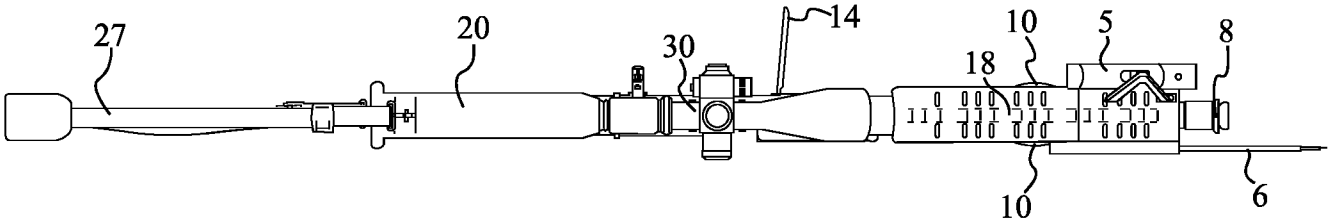
FIG. 6 illustrates a top view of the firearm combination according to other embodiments.

The electronic trigger 25 is an extra sensitive trigger 9 that reduces the amount of pressure required to fire the primary firearm 1; in addition, a user can adjust the sensitivity of the electronic trigger 25 to suit their personal preferences. The electronic trigger 25 is removable, allowing a user to attach the electronic trigger to the second trigger 24, secondary trigger 33, or to be omitted if so desired. The swivel control 10, as seen in FIG. 3-FIG. 5, is located midway along the length of the forend 19, with the swivel control 10 being accessible from each side of the forend 19. The main body of the swivel control 10 is housed within the forend 19, but since part of the swivel control 10 extends past the sides of the forend 19, it can still be controlled by a user. Located adjacent to the swivel control 10, at the front half of the forend 19, is the first mounting point 11.

The first mounting point 11 is connected to the underside of the forend 19 and serves as an attachment point for the secondary firearm 2. The first mounting point 11 is also connected to the swivel control 10, allowing a user to rotate the secondary firearm 2 by simply operating the swivel control 10. Alternatively, a user can rotate the secondary firearm 2 by hand, although this will still cause the swivel control 10 to rotate as the mounting point remains connected to the swivel control 10. The first mounting point 11 also includes a locking mechanism 26, such as a pin, that prevents the first mounting point 11 (and any attached items, such as the secondary firearm 2) from rotating. This allows a user to steady the secondary firearm 2 and prevent undesired movements.

The pistol defaults to being locked in a forward-facing position. The second mounting point 12, like the swivel control 10, is connected to the side of the forend 19. The second mounting point 12 is positioned adjacent to the muzzle 18 and serves as an attachment point for the electroshock weapon 5. Similar to the second mounting point 12, the third mounting point 13 is connected to the side of the forend 19, on the side opposite where the second mounting point 12 is connected. This third mounting point 13 serves as an attachment point for the knife 6.

To provide additional stability to the secondary firearm 2, another embodiment of the present invention incorporates a brace running from the swivel control 10 to the secondary firearm 2. This brace is bolted into the swivel control 10, helping to absorb recoil from firing the secondary firearm 2. The brace extends from the swivel control 10 to the secondary firearm 2, where a notch receives the grip of the secondary firearm 2. This addition is especially useful when using high-powered secondary firearms 2, where recoil may be more difficult to control than with low-power secondary firearms 2.

The first display 14, as shown in FIG. 4, is connected by a hinge to the side of the primary firearm 1. The hinge allows the first display 14 to rotate between an open and closed position. In a closed position the first display 14 is folded flat against the primary firearm 1, allowing a user an unobstructed view on that side of the primary firearm 1. In an open position, the first display 14 is rotated up to 180 degrees; in this open position the first display 14 is oriented so that it faces a user holding the primary firearm 1. On the opposite side of the primary firearm 1 is the fixed second display 15; it cannot be moved, either laterally or about an axis. The second display 15 is oriented so that its length is parallel to the primary barrel 8. Thus, when viewing the side of the primary firearm 1 (for example, if using the present invention to shoot around a corner), the second display 15 will be fully visible. A protective housing is provided for both the first display 14 and the second display 15.

Figure 7:
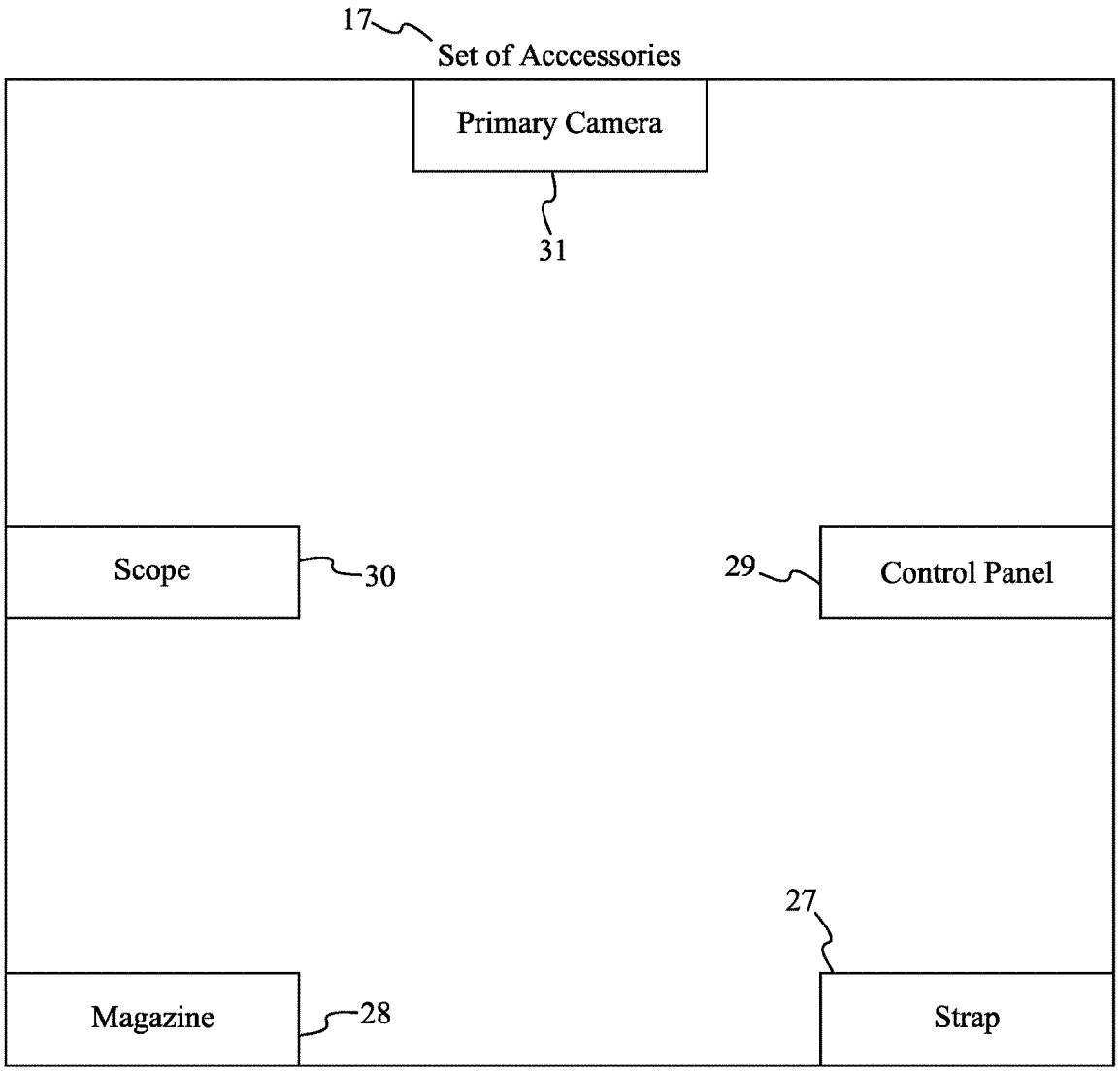
FIG. 7 depicts a block diagram of accessories for the firearm combination according to certain embodiments.

As outlined in FIG. 7, the set of accessories 17 comprises a strap 27, a magazine 28, a control panel 29, a scope 30, and a primary camera 31. The strap 27 connects to the rear end of the stock 16, adjacent to the telescoping shoulder rest 20, allowing a user to sling the strap 27 over their shoulder and make the present invention easier to carry or conceal. The magazine 28 is of a straight design and traverses into the primary firearm 1 and connects to the receiver 7, providing ammunition to the present invention. The control panel 29 is recessed into the primary firearm 1 and permits a user to interact with various components, including the displays and cameras. The scope 30 is positioned on top of the primary firearm 1, connected to the receiver 7.

The scope 30 is aligned with the primary barrel 8 to enhance aiming. The primary camera 31 is connected to the primary firearm 1 just below the muzzle 18, with the path of a fired bullet being directly above the primary camera 31. The primary camera 31 provides a view from the front of the primary firearm 1, displaying images and live video to the first display 14 and second display 15. This primary camera 31 allows a user to point the primary firearm 1 around corners or other obstacles and observe an area with being exposed to hazards, such as coming under fire from enemy combatants. The video output can be viewed on the first display 14 or the second display 15, depending on the orientation of a user in relation to the primary firearm 1.

As depicted in FIG. 5, the secondary firearm 2 comprises a secondary barrel 32, a secondary trigger 33, a secondary camera 34, and a cocking rod 35. The secondary firearm 2 attaches to the first mounting point 11. It has an axis of rotation perpendicular to the primary barrel 8 and traversing through a grip of the secondary firearm 2, such that the secondary barrel 32 rotates on a plane parallel to that of the primary barrel 8. The secondary trigger 33 is connected to the grip of the secondary firearm 2 and allows a user to fire the secondary firearm 2 as a standalone weapon used separately from the primary firearm 1. As with the primary firearm 1, the secondary camera 34 is positioned just below the muzzle 18 of the primary firearm 1. When the secondary firearm 2 is attached to the primary firearm 1, the secondary camera 34 provides a view from the secondary firearm's 2 point of perspective.

The view from the secondary camera 34 is output to the first display 14 and the second display 15, allowing a user to use the secondary camera 34 to view areas that the primary camera 31 might not be able to see. This is accomplished by rotating the secondary camera 34, providing a greater range of motion than found in the primary camera 31 alone. Rotating the secondary camera 34 in this manner could allow a user to see around an edge wall. This is done by rotating the secondary firearm 2 to be perpendicular to the primary firearm 1, then holding the primary firearm 1 so that it extends past an edge wall. Illustrated in FIG. 1, the cocking rod 35 is perpendicular to the secondary barrel 32, extending to one side of the secondary weapon. The cocking rod 35 provides a handle that can easily be used to cock the secondary weapon, which otherwise could prove difficult in the confined space of the present invention.

To fire the secondary firearm 2 from the main trigger 9, an L-shaped pin is included at the secondary trigger 33. When remotely activated, such as by the main trigger 9, this L-shaped pin extends to press the secondary trigger 33 and fire the secondary firearm 2. The L-shaped pin rotates 90 degrees, allowing the pin to be moved out of the trigger guard if a user chooses to manually operate the secondary firearm 2; in such a scenario, leaving the L-shaped pin in position would interfere with triggering the secondary firearm 2.

Figure 8:
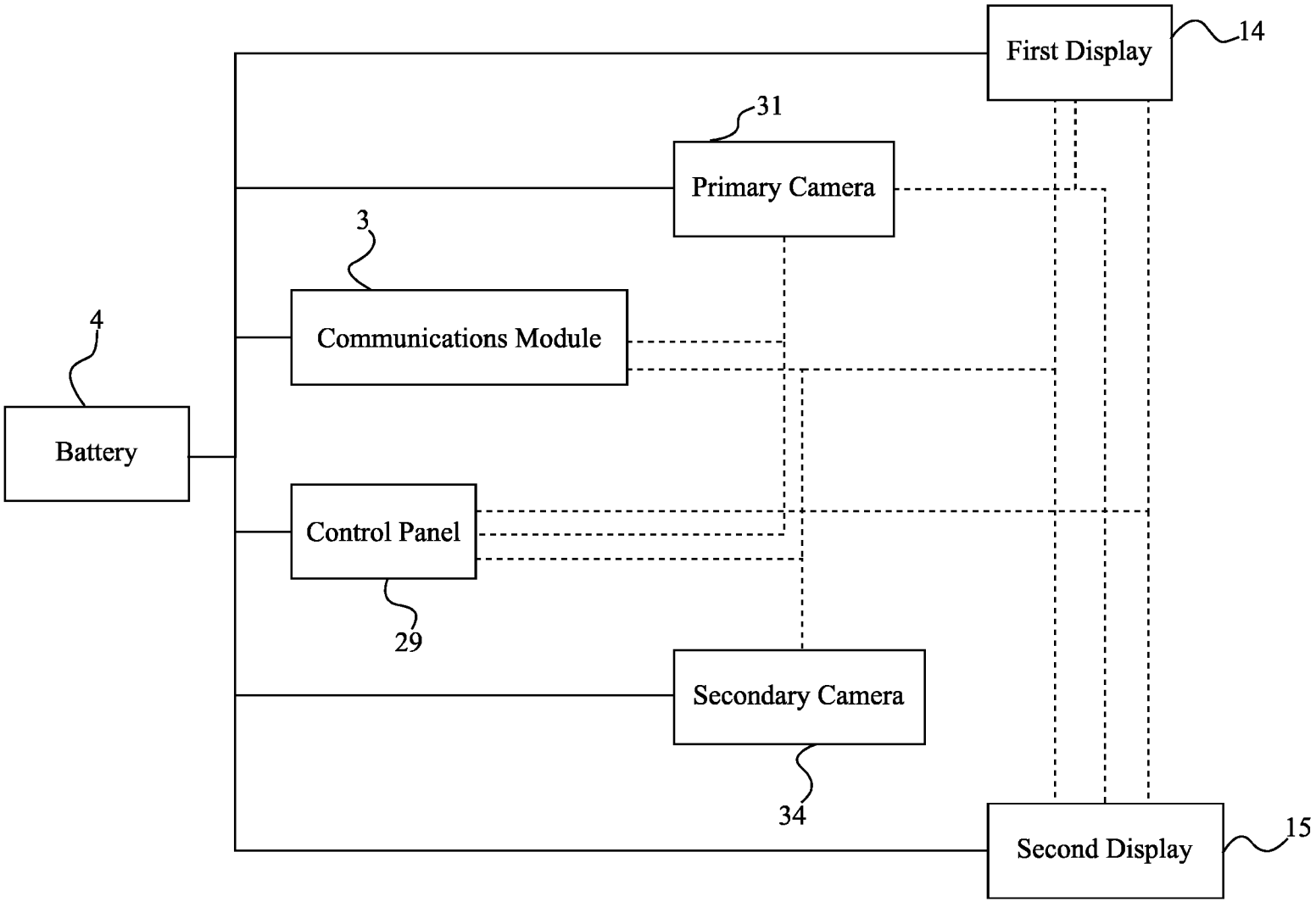
FIG. 8 depicts a block diagram of electronic components of the firearm combination according to yet still other embodiments.

The battery 4 provides power to the electronic components of the present invention, while the communications module 3 allows transmission of data to other devices, both of which are illustrated in FIG. 8. Preferably located in the trigger, the battery 4 is wired to provide power to integrated electrical components, including the first display 14, the second display 15, the control panel 29, the primary camera 31, the secondary camera 34, and the electronic trigger 25. The communications module 3 sends and receives information from the same electronic components that the battery 4 powers, which enables the present invention to interact with properly equipped external devices.

The electroshock weapon 5 and the knife 6 are attached to the second mounting point 12 and third mounting point 13, respectively, like seen in FIG. 1 - FIG. 6. The electroshock weapon 5 and knife 6 provide additional capabilities to a user of the present invention, offering non-lethal or close combat options. In addition, since the electroshock weapon 5 and knife 6 can be removed from the primary firearm 1, they can be used independently. The secondary firearm 2 can be removed and used independent of the primary firearm 1 in the same manner. This can prove advantageous when a non-lethal or close combat weapon is needed without having mobility being restricted by the primary firearm 1. That is, the secondary firearm 2, electroshock weapon 5, and knife 6 are all easier to wield and operate individually rather than when attached to the primary firearm 1. The quick-release mechanisms incorporated into the first mounting point 11, second mounting point 12, and third mounting point 13 make detaching the secondary firearm 2, electroshock weapon 5, and knife 6 a quick and easy task.

In the preferred embodiment of the present invention many components have specific or additional features. The overall construction of the primary firearm 1 incorporates a carbon fiber, or any other suitable metal, shell with vent holes. With regards to the stock 16, the telescoping shoulder is split into two sections, with a rear section sleeving into a front section, usually by means of a matching track and rail. This allows a user to adjust the length of the telescoping shoulder rest 20 as desired. The telescoping shoulder rest 20 preferably includes a hinge which allows the telescoping shoulder rest 20 to fold for compact storage, with the telescoping shoulder rest 20 being folded 180 degrees to rest adjacent and besides the receiver 7 section of the primary firearm 1.

The first display 14 and the second display 15 each can receive and display feeds from the primary camera 31 and secondary camera 34. The first display 14 and second display 15 can provide various levels of zoomed views depending on the zoom levels offered by the primary camera 31 and secondary camera 34. In addition, the first display 14 and second display 15 can provide split screen viewing, showing images from both the primary camera 31 and the secondary camera 34. This allows, for example, a user to switch the first display 14 to show two targets, one viewed from the primary camera 31 and the other viewed from the secondary camera 34. Targets are displayed using targeting sights that that can be rapidly switched. In addition to video feeds from the primary camera 31 and secondary camera 34, the first display 14 and second display 15 can output additional information, such as ammunition levels and the angle of the secondary firearm 2 in relation to the primary firearm 1.

The strap 27 preferably includes a padded section, making the present invention more comfortable to carry when the strap 27 is slung over a user's shoulder. The strap 27 enables a user to conceal the present invention by hiding it beneath a coat, with the strap 27 resting against a shoulder and the primary firearm 1 being held between a user's body and arm. The secondary firearm 2 is secured to the first mounting point 11 by a rotatable receiver 7, which is mechanically connected (such as by a chain and gear system) to the swivel control 10. This enables a user to rotate the secondary firearm by rotating the swivel control 10. The swivel control 10 rotates horizontally, with the axis of rotation being perpendicular to the length of the primary barrel 8 and roughly parallel to the rear grip 21. The primary camera 31 and secondary camera 34, as well as the second mounting point 12 and third mounting point 13, are properly distanced from the primary barrel 8 (or secondary barrel 32, in the case of the secondary camera 34) such that muzzle 18 blasts are not affected. The distancing of said components also protects against potential damage resulting from being too close to the muzzle 18 blast.

The primary firearm 1 and secondary firearm 2 each preferably include a safety to prevent accidental weapon discharges. The primary firearm 1 is preferably a rifle or assault rifle, while the knife 6 is preferably a switchblade or spring-based sliding knife 6, allowing the knife 6 blade to quickly be deployed for use. The primary camera 31 and secondary camera 34 are capable of alternate viewing modes, including night vision and infrared vision, although the primary camera 31 and secondary camera 34 default to an off state until a user opts to turn them on. In addition, the primary camera 31 and secondary camera 34 include removable storage devices. These removable storage devices can be used to record pictures and video taken from the primary camera 31 and secondary camera 34.

If a user wants to view the stored data on another interface, such as a portable laptop computer, the removable storage devices can be taken out of the primary camera 31 and secondary camera 34 and inserting into the portable laptop computer. In this manner recorded data is can be viewed on a large number of other devices. While the listed components have favored implementations, other embodiments can implement variant or optional components.

While the secondary firearm 2 is preferably a pistol, in other embodiments the secondary firearm 2 can take the form of a barrel without a grip or any type of projectile weapon, such as a grenade launcher. If a grip is not used, then the secondary trigger 33 would be omitted and the secondary weapon would be fully controlled through the trigger 9 and control panel 29 of the primary firearm 1. The electroshock weapon 5 is preferably a ranged implement such as the Taser™ that fires wires which carry current from the weapon to a target.

In other embodiments the swivel control 10 can be integrated into the control panel 29; rather than manually turning the swivel control 10, an interface on the control panel 29 could be operated to send electronic signals to the swivel mechanism for the secondary firearm 2, activating a motor to rotate the secondary firearm 2.. This allows a user to rotate the secondary firearm 2 with the simple push of a button. The swivel control 10 may also be disengaged, allowing a user to manually rotate the secondary firearm 2. These buttons would be positioned adjacent to the trigger 9, making them easily accessible to a user, within easy reach of the digits of the trigger hand.

In addition to the scope 30, the sighting mechanisms can include a laser sight and an iron sight. The laser sight and iron sight are attached atop the primary firearm 1, adjacent to the scope 30. Like the scope 30, the iron sight and laser sight should be aligned to be parallel to the primary barrel 8 to assist with aiming. The iron sight provides a sighting mechanism that can be used even if battery 4 power runs out, providing a backup option to the other targeting methods. Of course, adjustment could be made to the iron sight or laser sight if desired, perhaps to account for standard conditions (e.g. a typical range of engagement) that a user might face. It is also possible to include a sighting mechanism for the secondary firearm 2, though care would need to be taken to assure the sighting mechanism does not interfere with the first mounting point 11.

The telescoping shoulder rest 20 has the option of including a shock resistant feature, such as an air shock recoil reduction system, designed to buffer a user against recoil from firing the primary firearm 1 and secondary firearm 2. The air shock recoil reduction system allows a user to set and lock a pressure per their preference. The recoil reduction system can employ various energy damping methods or materials to reduce the impact of firing the primary firearm 1 and secondary firearm 2. For example, the air shock recoil system could be spring-based, gas-based, or any other recoil method deemed useful.

Other variations and subcomponents of the present invention relate to the receiver 7, stock 16, and firing mechanisms. Specifically, a shell ejection port is included so that empty casings can be automatically discarded from the primary firearm 1. The magazines used can be selected from a variety of options, such as box magazines. The stock 16 can include a front grip, opposite the rear grip 21, although the secondary firearm 2 can be used as a front grip while attached to the primary firearm 1. Additionally, though the preferred embodiment describes the electronic trigger 25 being attached to the first trigger 23, an optional second electronic trigger 25 could be attached to the second trigger 24. In either case the electronic trigger 25 activates an electronic firing system, reducing the pressure required to fire a shot.

The components of the present invention allow it to be used in conjunction with accessories 17 and external devices. A suitcase is designed for the present invention to store subcomponents, such as the primary firearm 1, secondary firearm 2, electroshock weapon 5, and knife 6. A headset can be synchronized to the present invention, using wireless communications to receive data. Additionally, an external control system, such as in a van, can be wirelessly connected to the present invention, allowing a third party to access some features of the present invention.

The suitcase includes multiple compartments for components and accessories 17 of the present invention. The suitcase is preferably of a thin, low-profile construction and is made to be airtight. In addition to a main compartment to house the primary firearm 1 and attached secondary firearm 2, there are individual compartments for the electroshock weapon 5, the knife 6, extra ammunition, and miscellaneous personal items. The headset can be placed in the main compartment alongside the present invention.

The headset includes a heads-up display, which is wirelessly connected to the communications module 3 of the present invention. The heads-up display receives information from the communications module 3, including video feeds from the primary camera 31 and secondary camera 34. Built in sight shields which can be flipped up or down are also integrated into the heads-up display. The heads-up display can be operated by handgrips built into either side of the heads-up display. The heads-up display can also be controlled by the control panel 29 of the primary firearm 1, which can send instruction through the communications module 3 to either lower or raise the sight shields. Thus, when a user wears the heads-up display while operating the present invention, views from the primary and secondary camera 34 can easily be seen without the need to focus on the first display 14 or second display 15.

The external control system, like the headset is wirelessly connected to the communications module 3. Not only is the external control system capable of receiving video feeds from the primary camera 31 and secondary camera 34, it is also capable of sending instructions to the present invention. For example, an operator of the external control system could see a target appear on the secondary camera 34, instruct the swivel control 10 to rotate the secondary firearm 2 to be pointing at the target, and fire the secondary firearm 2 by simply pressing a button. The instructions are all communicated wirelessly through the communications module 3. The primary benefits of the external control system are extra pairs of eyes to watch feeds from the primary camera 31 and secondary camera 34, providing a better chance to notice potential hazards that might escape the attention of a user of the present invention. If and when necessary, the external control system allows third parties to take control of the secondary firearm 2, perhaps acting before a user could, or alternatively allowing the present invention to fully engage two different targets simultaneously.

Figure 9:
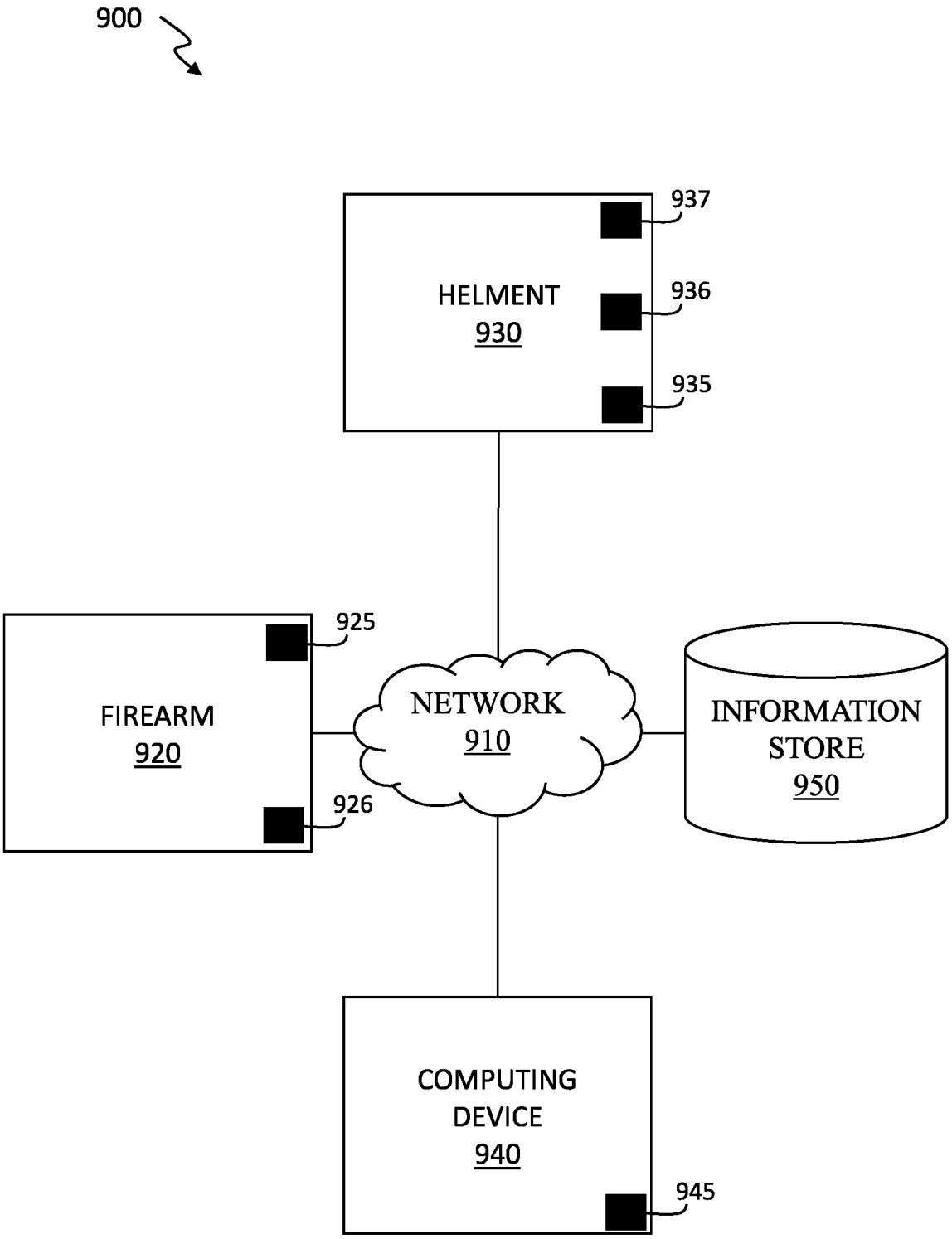
FIG. 9 depicts a block diagram of a targeting system according to some embodiments.

FIG. 9 depicts a block diagram of a targeting system ("system"), generally 900, in accordance with some embodiments. System 900 can include one or more of a firearm 920, helmet 930, information store 950, and user computing device 940 all connected via a network 910. Network 910 can be, for example, a local area network (LAN), a wide area network (WAN), such as the Internet, a distributed computing environment, or a combination of the two, and can include wired, wireless, or fiber optic connections. Network 910 can be compatible with a variety of frequencies, such as those associated with Bluetooth, Wi-Fi, LTE, cellular, radio, microwave, as well as other wireless communication protocols.

In general, network 910 can be any combination of connections and protocols that will support communications between helmet 930, firearm 920, computing device 940, and information store 950. The computing device 940 can be one or more desktop computers, laptop computers, tablet computers, wearable computers, cluster computers, or other computing devices capable of performing one or more steps, methods, and/or processes disclosed herein. The computing device 940 preferably includes user interface 945. The user interface 945 is software that allows a user to communicate with the firearm 920 and/or the helmet 930. Information store 950 is an organized collection of data, generally stored and accessed electronically.

The helmet 930 is preferably a combat helmet specifically configured to protect the head during combat. In some embodiments, the helmet 930 is headgear (i.e. any element of clothing which is worn on a person's head) that provides protection, conveys fashion or decorations, serves a religious or medical purpose, or serves as a component of a uniform. In general, the helmet 930 is an item of clothing that can be worn on the head of a person and communicate via the network 910 according to certain embodiments. The helmet 930 preferably includes a communications device 937, a helmet display 936, and user interface 935. The helmet display 936 is preferably a heads-up display to allow the user to observe and/or interact with data as without looking away from the firearm 920, the ambient environment, or other object(s).

The helmet display 936 allows users to communicate with the firearm 920 and the computing device 940 while still observing their ambient environment. In general, the helmet display 936 is a transparent display that presents data without requiring the user to look away from their usual viewpoints. The user interface 935 is software that allows a user to communicate (e.g., via text, audio, video, etc.) with the firearm 920 and/or the helmet 930. The user interface 935 is preferably a graphical user interface composed of a tactile UI and a visual UI capable of displaying graphics. To be sure, the user interface 945 functions similar to the user interface 935. The user interface 935 and/or 945 can include a motion alarm associated with the primary firearm 1 and the second firearm 2. A combination keypad may be used to set and disarm the motion alarm. The alarm can be configured to communicate with mobile devices. Although in other embodiments more or less components may be present, the firearm 920 includes the primary firearm 1 and the secondary firearm 2 interconnected as disclosed above according to preferred embodiments. In preferred embodiments, the primary firearm 1 and the secondary firearm 2 are configured and interconnected as well as function as discussed above.

To be sure, the following components and functionality are reiterated to aid in the discussion of FIGS. 9-12. Briefly, the swivel control 10 is functionally coupled to the secondary firearm 2; the secondary firearm 2 is rotatably coupled to the first mounting point 11; the first mounting point 11 is positioned below the primary barrel 8; the primary barrel 8 is positioned parallel to the secondary barrel 32; the secondary firearm 2 comprises an angle of rotation when attached to the first mounting point 11; the angle of rotation is perpendicular to the primary barrel 8 and the secondary barrel 32; the secondary firearm 2 is demountably and rotatably coupled to the first mounting point 11; the first display 14 is positioned adjacent to and rotatably coupled to the primary firearm 1; and the second display 15 is positioned recessed into the primary firearm 1.

As discussed above, the secondary firearm 2 preferably includes the secondary camera 34 and the second barrel 32. The firearm 920 includes one or more control circuits 926 communicatively coupled to the helmet 930, the computing device 940, the first display 14, the second display 15, the electronic trigger 25, the primary camera 31, the secondary camera 34, the control panel 29, and the control panel 29.

The primary barrel 8, is functionally coupled to the receiver 7. The heads-up display 936 is preferably a transparent display that presents data without requiring users to look away from their usual viewpoints. According to certain embodiments, the primary barrel 8 can be configured to discharge bullets, shot, slugs, grenades, barbed darts, darts, less-lethal munitions, airsoft, foam munitions, and/or similar projectiles. In other words, the primary barrel 8 can be a long gun barrel, a pistol barrel, or a shotgun barrel. The system 900 is preferably a man-portable system that does not require vehicle support to transport or operate (e.g., can be carried by hand). As previously discussed, the primary firearm 1 and the secondary firearm 2 are each man-portable.

Figure 10:
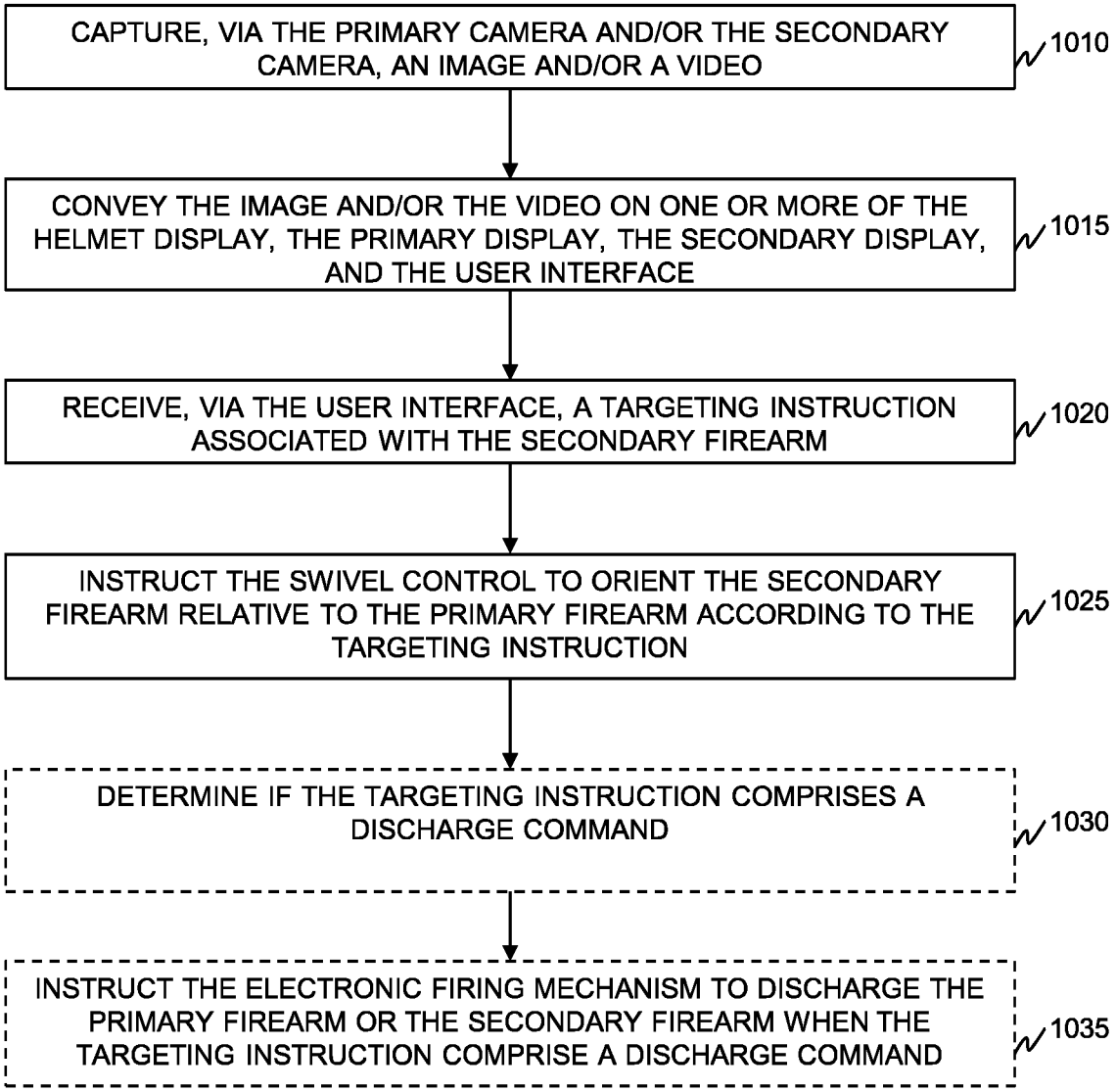
FIG. 10 depicts process step for receiving targeting via a user interface of the targeting system according to certain embodiments.

FIG. 10 depicts process steps for operating the system 900, in accordance with other embodiments. Specifically, FIG. 10 depicts the steps for acquiring two targets with system 900 according to some embodiments. The control circuit 925 can be configured to perform one or more steps, methods, processes, functions disclosed herein. The system 900 can be utilized on a battlefield to simultaneously identify, track, and/or engage two targets. The primary camera 31 and/or the secondary camera 34 capture at least one image and/or video (Step 1010). Image and/or videos are conveyed on one or more of the helmet display 936, the first display 14, the second display 15, and the user interface 945 (Step 1015). One or more targeting instructions (e.g., rotate the secondary firearm left 15.27 degrees) associated with the secondary firearm 2 are received from the user interface 945 (Step 1020). The swivel control 10 is instructed to orient the secondary firearm 2 relative to the primary firearm 1 according to the targeting instruction and thereby acquire a sight picture (Step 1025).

In preferred embodiments, the firearm 920 includes an electronic firing mechanism 925, which is an electronic system that is functionally coupled to the primary firearm 1 and the secondary firearm 2. For example, the electronic firing mechanism 925 is an electronic mechanical assembly that can discharge the primary firearm 1 and/or the secondary firearm 2 when instructed. At Step 1030, whether the targeting instructions includes discharge commands (e.g., discharge the primary firearm 1 and/or the secondary firearm 2) is determined. At Step 1035, the electronic firing mechanism 925 is instructed to discharge the primary firearm 1 or the secondary firearm 2 when the targeting instruction comprise a discharge command. Here, discharge commands are associated with the primary firearm 1 and/or the secondary firearm 2 (e.g., discharge the primary firearm 1). Hence, at the conclusion of Step 1035, the primary barrel 8 and the secondary barrel 32 have different barrel angles.

Figure 11:
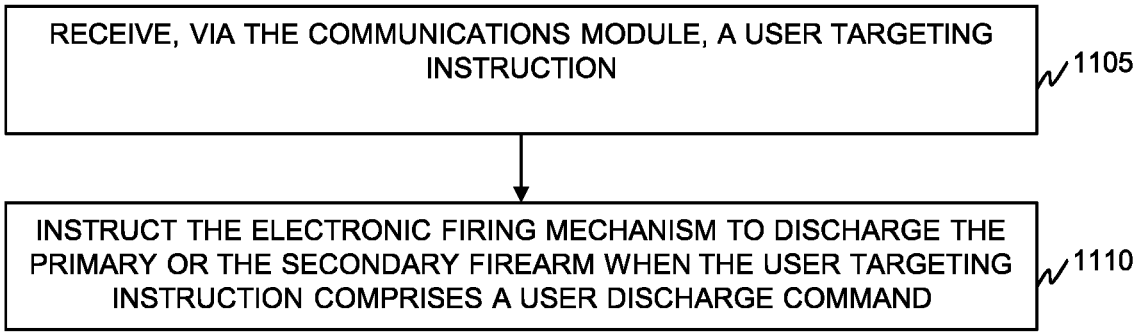
FIG. 11 depicts process steps for receiving targeting instructions via a communications module of the targeting system according to other embodiments.

FIG. 11 depicts process steps for operating the system 900, in accordance with yet still other embodiments. Specifically, FIG. 11 depicts steps for discharging the system 900 via commands sent via the helmet 930 according to certain embodiments. Here, the helmet 930 preferably includes a communications module 937. The communications module 937 is preferably configured to communicate with at least the firearm 920 and the computing device 940. In general, the communications 937 includes a transceiver that can send and/or receive data (e.g., text, audio, and/or video), in accordance with some embodiments. At Step 1105, user targeting instructions are received from the communications module 937. For example, a user generates the targeting instructions and transmits them via the communications module 937. At Step 1110, the electronic firing mechanism 926 is instructed to discharge the primary firearm 1 or the secondary firearm 2 when the user targeting instruction includes one or more user discharge commands. The user discharge commands are associated with the primary firearm 1 of the secondary firearm 2.

Figure 12:
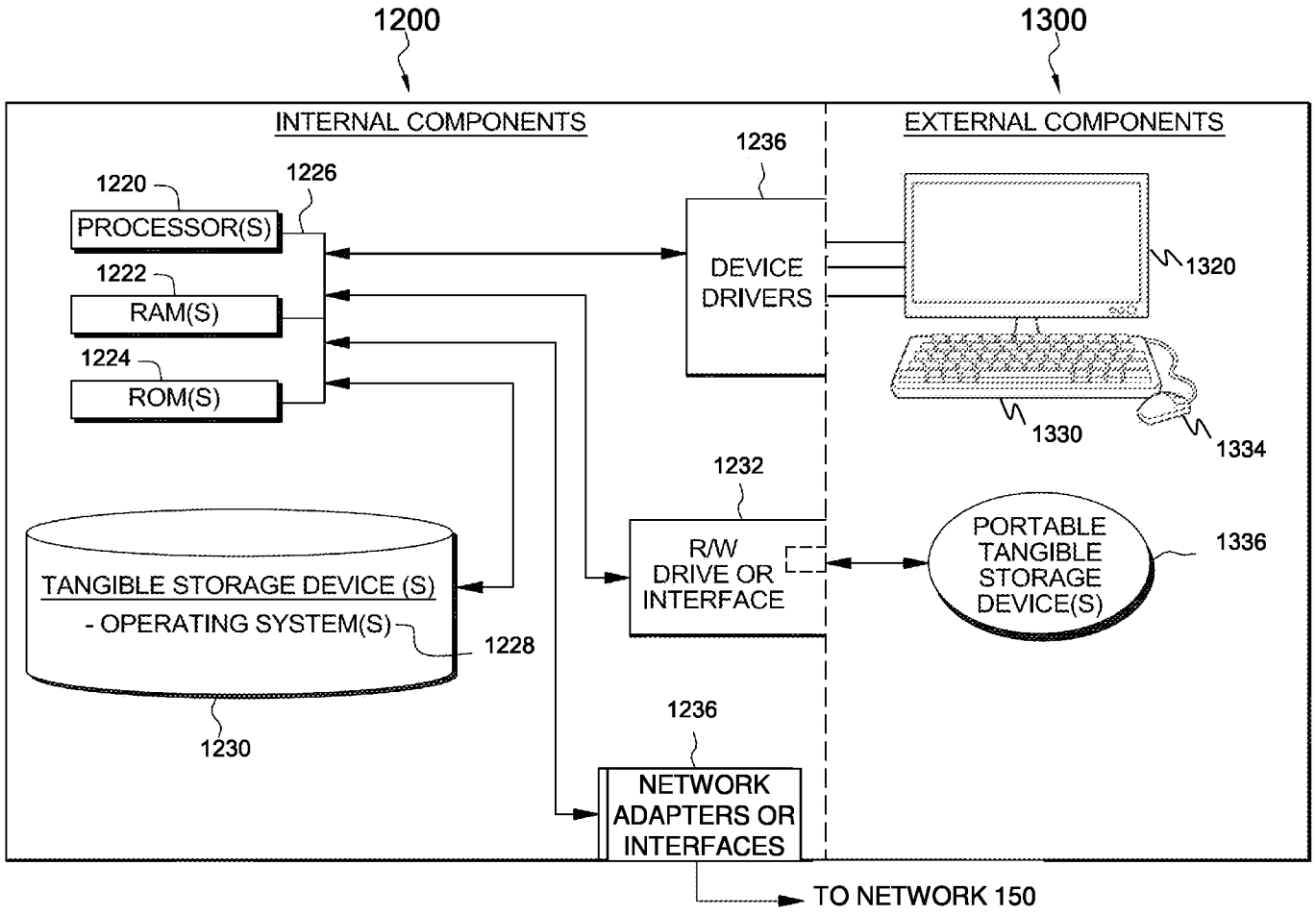
FIG. 12 illustrates a system diagram according to yet still other embodiments.

FIG. 12 depicts a block diagram of components of computing device 940 according some embodiments. Data processing system 1200, 1300 is representative of any electronic device capable of executing machine-readable program instructions. Data processing system 1200, 1300 may be representative of a smart phone, a computer system, PDA, or other electronic devices. Examples of computing systems, environments, and/or configurations that may represented by data processing system 1200, 1300 include, but are not limited to, personal computer systems, server computer systems, thin clients, thick clients, wearable computer, hand-held or laptop devices, multiprocessor systems, microprocessor-based systems, network PCs, minicomputer systems, and distributed cloud computing environments that include any of the above systems or devices.

Computing device 940 includes respective sets of internal components 1200 and external components 1300 as illustrated in FIG. 12. Each of the sets of internal components 1200 includes one or more processors 1220, one or more computer-readable RAMs 1222 and one or more computer-readable ROMs 1224 on one or more buses 1226, and one or more operating systems 1228 and one or more computer-readable tangible storage devices 1230. One or more of methods, processes, and or steps disclosed herein are stored on one or more of the respective computer-readable tangible storage devices 1230 for execution by one or more of processors 1220 via one or more of the respective RAMs 1222 (which typically include cache memory). In the embodiment illustrated in FIG. 12, each of the computer-readable tangible storage devices 1230 is a magnetic disk storage device of an internal hard drive. Alternatively, each of the computer-readable tangible storage devices 1230 is a semiconductor storage device, such as ROM 1224, EPROM, flash memory or any other computer-readable tangible storage device that can store a computer program and digital information.

Internal components 1200 also include a R/W drive or interface 1232 to read from and write to one or more portable computer-readable tangible storage devices 1336, such as a CD-ROM, DVD, memory stick, magnetic tape, magnetic disk, optical disk or semiconductor storage device. Methods, processes, and or steps disclosed herein can be stored on one or more of the respective portable computer-readable tangible storage devices 1336, read via the respective R/W drive or interface 1232 and loaded into the respective computer-readable tangible storage devices 1230.

Each set of internal components 1200 also includes network adapters or interfaces 1236 such as a TCP/IP adapter cards, wireless Wi-Fi interface cards, or 3G or 4G wireless interface cards or other wired or wireless communication links. Methods, processes, and or steps disclosed herein can be downloaded to computing device 940, respectively, from an external computer via a network (for example, the Internet, a local area network or other, wide area network) and respective network adapters or interfaces 1236. From the network adapters or interfaces 1236, captured images, methods, processes, and or steps disclosed herein are loaded into the respective computer-readable tangible storage devices 1230. The network may comprise copper wires, optical fibers, wireless transmission, routers, firewalls, switches, gateway computers and/or edge servers.

Each of the sets of external components 1300 can include a computer display monitor 1320, a keyboard 1330, and a computer mouse 1334. External components 600 can also include touch screens, virtual keyboards, touch pads, pointing devices, and other human interface devices. Internal components 1200 also include device drivers 1240 to interface to computer display monitor 1320, keyboard 1330 and computer mouse 1334. The device drivers 1240, R/W drive or interface 1232 and network adapters or interfaces 1236 comprise hardware and software (stored in storage device 1230 and/or ROM 1224).

Computer program code for carrying out operations of the present invention may be written in any combination of one or more programming languages, including an object oriented programming language such as Java, Smalltalk, C++or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network ("LAN") or a wide area network ("WAN"), or the connection may be made to an external computer (for example, though the Internet using an Internet Service Provider).

Based on the foregoing, computer system, method and program product have been disclosed in accordance with the present invention. However, numerous modifications and substitutions can be made without deviating from the scope of the present invention. Therefore, the present invention has been disclosed by way of example and not limitation.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments but should be defined only in accordance with the following claims appended hereto and their equivalents.

Although the disclosure has been explained in relation to its preferred embodiment, it is to be understood that many other possible modifications and variations can be made without departing from the spirit and scope of the disclosure.

What is claimed is:

1. A targeting system, the system comprising:
- a helmet comprising a helmet display;
- a primary firearm comprising: a receiver, a primary barrel, a primary camera, a swivel control, a first mounting point, a first display, and a second display;
- a secondary firearm comprising a secondary camera, a secondary barrel, a secondary camera;
- a computing device comprising an user interface;
- a control circuit communicatively coupled to the helmet, the firearm apparatus, and the user interface;
- wherein
  - the primary barrel functionally coupled to the receiver;
  - the helmet display is a heads-up display;
  - the swivel control is functionally coupled to the secondary firearm;
  - the secondary firearm is rotatably coupled to the first mounting point;
  - the control circuit is configured to:
    - capture, via the primary camera and/or the secondary camera, an image and/or a video;
    - convey the image and/or the video on one or more of the helmet display, the primary display, the secondary display, and the user interface;
    - receive a targeting instruction associated with the secondary firearm from the user interface; and
    - instruct the swivel control to orient the secondary firearm relative to the primary firearm according to the targeting instruction and thereby acquire a sight picture.

2. The system of claim 1, wherein the first mounting point is positioned below the primary barrel.

3. The system of claim 2, wherein the primary barrel is positioned parallel to the secondary barrel.

4. The system of claim 3, wherein
- the secondary firearm comprises an angle of rotation when attached to the first mounting point; and
- the angle of rotation is perpendicular to the primary barrel and the secondary barrel.

5. The system of claim 4, further comprising an electronic firing mechanism
- wherein
  - the electronic firing mechanism is functionally coupled to the primary firearm and the secondary firearm;
  - the control circuit is configured to:
    - determine if the targeting instruction comprises a discharge command;
    - instruct the electronic firing mechanism to discharge the primary firearm or the secondary firearm when the targeting instruction comprise a discharge command; and the discharge command is associated with the primary firearm or the secondary firearm.

6. The system of claim 5, wherein the helmet comprises a communications module; and the control circuit is configured to:

receive a user targeting instruction from the communications module;

instruct the electronic firing mechanism to discharge the primary firearm or the secondary firearm when the user targeting instruction comprises a user discharge command; and the user discharge command is associated with the primary firearm of the secondary firearm.

7. The system of claim 6, wherein the primary barrel is configured to discharge one of a bullet, shot, and a slug.

8. The system of claim 7, wherein the primary firearm and the secondary firearm are man-portable.

9. The system of claim 8, wherein the secondary firearm is demountably and rotatably coupled to the first mounting point.

10. The system of claim 9, wherein the first display is positioned adjacent to the primary firearm;

rotatably coupled to the primary firearm; and the second display is positioned recessed into the primary firearm.

11. A targeting system, the system comprising:

a helmet comprising a helmet display;

a primary firearm comprising: a receiver, a primary barrel, a primary camera, a swivel control, a first mounting point, a first display, and a second display;

a secondary firearm comprising a secondary camera, a secondary barrel, a secondary camera;

a computing device comprising an user interface;

a control circuit communicatively coupled to the helmet, the firearm apparatus, and the user interface;

wherein the first mounting point is positioned below the primary barrel;

the primary barrel functionally coupled to the receiver;

the helmet display is a heads-up display;

the swivel control is functionally coupled to the secondary firearm;

the secondary firearm is rotatably coupled to the first mounting point;

the control circuit is configured to:

capture, via the primary camera and/or the secondary camera, an image and/or a video;

convey the image and/or the video on one or more of the helmet display, the primary display, the secondary display, and the user interface;

receive a targeting instruction associated with the secondary firearm from the user interface; and instruct the swivel control to orient the secondary firearm relative to the primary firearm according to the targeting instruction and thereby acquire a sight picture.

12. The system of claim 11, wherein the primary barrel is positioned parallel to the secondary barrel.

13. The system of claim 12, wherein the secondary firearm comprises an angle of rotation when attached to the first mounting point; and the angle of rotation is perpendicular to the primary barrel and the secondary barrel.

14. The system of claim 13, further comprising an electronic firing mechanism wherein the electronic firing mechanism is functionally coupled to the primary firearm and the secondary firearm;

the control circuit is configured to:

determine if the targeting instruction comprises a discharge command;

instruct the electronic firing mechanism to discharge the primary firearm or the secondary firearm when the targeting instruction comprise a discharge command; and the discharge command is associated with the primary firearm or the secondary firearm.

15. The system of claim 14, wherein the helmet comprises a communications module; and the control circuit is configured to:

receive a user targeting instruction from the communications module;

instruct the electronic firing mechanism to discharge the primary firearm or the secondary firearm when the user targeting instruction comprises a user discharge command; and the user discharge command is associated with the primary firearm of the secondary firearm.

16. The system of claim 15, wherein the primary barrel is configured to discharge one of a bullet, shot, and a slug.

17. The system of claim 16, wherein the primary firearm and the secondary firearm are man-portable.

18. The system of claim 17, wherein the secondary firearm is demountably and rotatably coupled to the first mounting point.

19. A targeting system, the system comprising:

a helmet comprising a helmet display;

a primary firearm comprising: a receiver, a primary barrel, a primary camera, a swivel control, a first mounting point, a first display, and a second display;

a secondary firearm comprising a secondary camera, a secondary barrel, a secondary camera;

a computing device comprising an user interface;

a control circuit communicatively coupled to the helmet, the firearm apparatus, and the user interface;

wherein the primary barrel is positioned parallel to the secondary barrel;

the first mounting point is positioned below the primary barrel;

the primary barrel functionally coupled to the receiver;

the helmet display is a heads-up display;

the swivel control is functionally coupled to the secondary firearm;

the secondary firearm is rotatably coupled to the first mounting point;

the control circuit is configured to:

capture, via the primary camera and/or the secondary camera, an image and/or a video;

convey the image and/or the video on one or more of the helmet display, the primary display, the secondary display, and the user interface;

receive a targeting instruction associated with the secondary firearm from the user interface; and instruct the swivel control to orient the secondary firearm relative to the primary firearm according to the targeting instruction and thereby acquire a sight picture.

20. The system of claim 19, further comprising an electronic firing mechanism wherein the electronic firing mechanism is functionally coupled to the primary firearm and the secondary firearm;

the control circuit is configured to:

determine if the targeting instruction comprises a discharge command;

instruct the electronic firing mechanism to discharge the primary firearm or the secondary firearm when the targeting instruction comprise a discharge command; and the discharge command is associated with the primary firearm or the secondary firearm.

* * * * *